US008328078B2

(12) United States Patent
Modha et al.

(10) Patent No.: US 8,328,078 B2
(45) Date of Patent: Dec. 11, 2012

(54) CONTAINER

(75) Inventors: Asit Modha, Middlesex (GB); William John Davis, Bath (GB)

(73) Assignee: Cadbury Holdings Limited, Middlesex (GB)

( * ) Notice: Subject to any disclaimer, the term of this patent is extended or adjusted under 35 U.S.C. 154(b) by 560 days.

(21) Appl. No.: 12/518,586

(22) PCT Filed: Nov. 29, 2007

(86) PCT No.: PCT/GB2007/004582

§ 371 (c)(1),
(2), (4) Date: Mar. 31, 2010

(87) PCT Pub. No.: WO2008/071908

PCT Pub. Date: Jun. 19, 2008

(65) Prior Publication Data

US 2010/0282830 A1 Nov. 11, 2010

(30) Foreign Application Priority Data

Dec. 15, 2006 (GB) ..... 0625012.0

(51) Int. Cl.
*B65D 17/28* (2006.01)

(52) U.S. Cl. ..... 229/221; 229/131.1; 229/144; 229/145; 229/231

(58) Field of Classification Search ..... 229/131.1, 229/144, 145, 146, 160.1, 221, 231; 206/268
See application file for complete search history.

(56) References Cited

U.S. PATENT DOCUMENTS

| | | | | | |
|---|---|---|---|---|---|
| 2,017,129 | A | * | 10/1935 | Osterberg | 229/145 |
| 2,355,665 | A | * | 8/1944 | Mabee | 229/145 |
| 2,445,001 | A | * | 7/1948 | Pence | 206/268 |
| 3,173,600 | A | * | 3/1965 | Michalka | 229/146 |
| RE26,471 | E | * | 10/1968 | Meyers | 229/145 |
| 3,680,766 | A | * | 8/1972 | Collura et al. | 229/145 |
| 4,201,329 | A | * | 5/1980 | Roccaforte | 229/131.1 |
| 5,248,031 | A | * | 9/1993 | Burrows et al. | 206/268 |
| 5,348,219 | A | * | 9/1994 | Brintazzoli | 229/131.1 |
| 5,653,384 | A | * | 8/1997 | Shaikh | 229/145 |
| 6,929,121 | B2 | * | 8/2005 | Boriani et al. | 206/268 |
| 7,658,318 | B2 | * | 2/2010 | Walsh et al. | 229/231 |

FOREIGN PATENT DOCUMENTS

JP 08 048328 2/1996

* cited by examiner

*Primary Examiner* — Gary Elkins
(74) *Attorney, Agent, or Firm* — Hoffmann & Baron, LLP

(57) ABSTRACT

A confectionery container (10) has a main body (12) defining an inner volume in which articles can be held. A closure member or lid (14) is pivotably attached to the main body for movement between an open position in which articles within the inner volume can be dispensed and a closed position in which the articles are retained within the container. To assist the user in opening and closing the container, an over-center mechanism (34) is provided which is configured to bias the lid (14) towards the open and closed positions. The container (10) is preferably formed from a unitary blank of foldable material (48) and the over-center mechanism may comprise two co-operating panels (36, 40) connected between the main body (12) and the lid (14). A blank (48) for forming the container and a method of dispensing articles from the container are also disclosed.

27 Claims, 3 Drawing Sheets

CONTAINER

CROSS-REFERENCE TO RELATED APPLICATIONS

This application is the National Stage of International Application No. PCT/GB2007/004582, which designates the U.S., filed Nov. 29, 2007, which claims the benefit of GB 0625012.0, filed Dec. 15, 2006, the contents of which are incorporated by reference herein.

FIELD OF THE INVENTION

This invention is concerned with containers, particularly, although not exclusively, to containers for the containment and dispense of articles in tablet or pellet form, including confectionery items. The invention also relate to blanks for forming such containers and to a method of dispensing articles using the inventive container.

BACKGROUND OF THE INVENTION

Known containers comprise a box-like main body with an open end and having an interior in which contents can be stored. A closure member or lid is pivotably mounted to the body for movement between a closed position in which it closes off the open end and an open position in which a user can gain access to the interior of the container through the open end or in which the contents can be dispensed though the open end. These arrangements are commonly adopted for the containment and dispensing of cigarettes for example and are typically formed from a blank of foldable material such as cardboard or a laminate or the like. However, such known containers are not always suitable for the dispensing of smaller confectionery items or tablet-form medications. Furthermore, the arrangements for opening and closing the closure member can be awkward and/or unreliable.

SUMMARY OF THE INVENTION

An object of the present invention therefore is to provide a confectionery container which is suitable for the containment and dispersing of pellet or tablet like articles which may be confectionery articles such as chewing gum pellets or mints or tablet-form medications.

A further object of the invention is to provide a confectionery container having an improved opening and closing mechanism for the dispensing of such articles.

Additionally, it is an object of the invention to provide a confectionery container that is simple to make and fill.

It is a further object of the invention to provide a blank for the manufacture of a confectionery container with the above-mentioned attributes.

It is a yet further object of the invention to provide an improved method of dispensing articles from a confectionery container.

According to a first aspect of the invention, there is provided a confectionery container comprising a main body defining an inner volume in which articles can be held and a closure member pivotably attached to the main body for movement between an open position in which articles within the inner volume can be dispensed and a closed position in which the articles are retained within the container, the container further comprising an over-centre mechanism arranged to bias the closure member towards the open and closed positions.

In a confectionery container in accordance with the first aspect of the invention, the over-centre mechanism facilitates opening and closing of the container, thereby requiring minimal direction from a user. Furthermore, the over-centre mechanism positively directs the closure member into the open and closed positions, reducing the possibility of incorrect positioning of the colure member or accidental movement between open/closed positions. This is particularly advantageous where the articles to be dispensed are confectionery articles or medicaments as the over-centre mechanism ensures efficient closure which is important for hygiene reasons and to ensure the integrity of the articles stored in the container.

The term "over-centre mechanism" in this context refers to a mechanism having a range of movement between two extremes and having an intermediate transition point between those two extremes, the arrangement being such that the forces applied by the mechanism are different when the mechanism is on one side of the intermediate transition point than when it is on the other. Thus in the present invention, the over-centre mechanism applies a bias force tending to move the closure member towards the open position when the mechanism moves beyond the intermediate position towards an open configuration and applies a bias force tending to move the closure member towards the closed position when the mechanism moves beyond the intermediate position towards a closed configuration.

The over-centre mechanism may comprise a pair of pivotably interconnected link members, one link member being pivotably connected to the closure member and the other link member being pivotably connected to the main body.

The confectionery container may be constructed from one or more sections of foldable material, such as card, paper or a laminate. In a particularly advantageous arrangement, the container is formed from a unitary blank of foldable material.

The over-centre mechanism may comprise two cooperating panels pivotably connected to one another along a first fold line, a first one of the panels being pivotably connected with the closure member and a second of the cooperating panels being pivotably connected with a panel forming part of the main body. The cooperating panels may be configured so as to lie generally in-line with each other when the closure is in the open position, though, the first and second cooperating panels may angle inwardly towards their adjoining ends, such that the first fold line is offset inwardly from the plane of the main body panel. The cooperating panels may be configured so that the first and second cooperating panels overlie one another when the closure member is in the closed position.

The cooperating panels may be configured so that, in use, as the closure member moves between the open and closed positions, the first cooperating panel pivots about the first fold line and is inverted, the closure member passing through an intermediate position between the open and closed positions in which the first cooperating panel extends generally perpendicularly to the plane of the second cooperating panel.

The cooperating panels may be configured so that, in use when the closure member is moved from the open position to the closed position, during movement of the closure member from the open position to the intermediate position, a force is exerted on the second cooperating panel through the first cooperating panel biasing the second cooperating panel inwardly from an initial position, after which, during further movement of the closure member towards the closed position beyond the intermediate position, the force on the second cooperating panel is removed and the second panel is able to recover towards its initial position biasing the closure member towards the closed position.

The cooperating panels may be re arranged so that, in use when the closure member is moved from the closed position to the open position, during movement of the closure member from the closed position towards the intermediate position, a force is exerted on the second cooperating panel through the first cooperating panel biasing the second cooperating panel inwardly from an initial position, after which, during further movement of the closure member towards the open position beyond the intermediate position, the force exerted on the second cooperating panel is removed and the second cooperating panel is able to recover towards its initial position biasing the closure member towards the open position.

The first cooperating panel may be a major panel and the second cooperating panel may be a shorter minor panel.

In one embodiment, the main body has opposing front and rear panels, the closure member being pivotably connected with a rear panel of the main body, the first cooperating panel being pivotably connected with a forward edge of the closure member and the second cooperating panel being pivotably connected with the front panel of the main body.

The closure member may comprise two closure member panels, a first closure member panel pivotably connected with the rear panel of the main body and a second closure member panel which extends substantially perpendicularly to the first closure member panel. The second closure member panel may have a dispensing aperture and may be arranged to at least partially overlie the front panel of the main body and the first and second cooperating panels when the closure member is in the closed position so that the aperture is at least partially obscured.

In this arrangement, it is advantageous that the over-centre mechanism biases the second closure member panel into close proximity with the front panel of the main body and the first and second cooperating panels as this helps to close the aperture as far as possible. This not only reduces the risk that articles might inadvertently escape through the aperture but also helps to prevent containments entering the container. It is also an advantage that the user can clearly see the dispensing aperture and how to open the container.

The dispensing aperture may be un-obscured when the closure member is in the open position.

The closure member may be provided at one end of the main body, the second closure member panel being arranged to extend substantially parallel to a wall which closes an opposing end of the main body when the closure member is in the open position.

The dispensing aperture may be provided by means of a push out panel defined in the second closure member panel by means of perforations.

In one embodiment, the first closure member panel is connected with the rear panel of the main body by a fold line and to the second closure member panel by a further fold line, the container further comprising a tab member pivotably connected to one of the first cooperating panel and the second closure member panel by a yet further fold line, the tab member being secured to the other of the first cooperating panel and the second closure member panel.

In an alternative embodiment, the second closure member panel is connected with the first cooperating panel by means of a fold line and to the first closure member panel by means of a further fold line, the container further comprising a tab member pivotably connected with one of the rear panel of the main body and the first closure member panel by means of a yet further fold line, the tab member being secured to the other of the rear panel and the first closure member panel.

In either of the above embodiments, the tab member may be secured using an adhesive.

The closure member may further comprise side tabs to enclose the region between the closure member panels and the first cooperating panel when the closure member is in the open position.

In accordance with a second aspect of the invention, there is provided a blank for forming a confectionery container in accordance with the first aspect of the invention.

The blank may comprise two cooperating panels pivotably connected with a panel portion forming part of the main body, the two cooperating panels being interconnected by a fold line.

In one embodiment, the blank comprises four panel portions connected by fold lines which define front, rear and two side panels of the main body of the container, the blank further comprising a first closure member panel connected to the rear panel portion by a fold line, a second closure member panel connected to the first closure member panel by a fold line, a second cooperating panel connected with the front panel portion by a fold line and a first cooperating panel connected with the second cooperating panel by a fold line, and a tab member connected with one of the first cooperating panel and the second closure member panel by a fold line, the tab member carrying a region of adhesive by means of which it can be affixed to the other of the first cooperating panel and the second closure member panel.

In an alternative embodiment, the blank comprises four panel portions connected by fold lines which define front, rear and two side panels of the main body of the container, the blank further comprising a second cooperating panel connected with the front panel portion by a fold line, a first cooperating panel connected with the second cooperating panel by a fold line, a second closure member panel connected with the first cooperating panel by a fold line, and a first closure member panel connected with the second closure member panel by a fold line, and a tab member connected with one of the rear panel portion and the first closure member panel by a fold line, the tab member carrying a region of adhesive by means of which it can be affixed to the other of the rear panel portion and the first closure member panel.

The blank may further comprise end closure panels and tabs for forming an end closure at an end of the main body opposite from the closure member.

The blank may have adhesive on one or more faces to facilitate assembly of the container.

In accordance with a third aspect of the invention, there is provided a method of dispensing articles from a confectionery container in accordance with the first aspect of the invention, the method comprising: moving the closure member from the closed position to the open position and manoeuvring the container so as to dislodge articles in the container to be dispensed.

The method may further comprise moving the closure member from the open position to the closed position to retain the remaining articles within the container.

Where the main body of the confectionery container comprises opposing front and rear panels and the closure member comprises a first closure member panel pivotably connected with the rear panel of the main body, a second closure member panel extending generally perpendicularly to the first closure member panel and which has a dispensing aperture, the second closure member panel being arranged to at least partially overlie the front panel of the main body and the first and second cooperating panels when the closure member is in the closed position, the step of moving the closure member to the closed position may cause the over-centre mechanism to bias the second closure panel into close proximity with the front panel and the first and second cooperating panels so that the aperture is at least partially obscured.

Where the closure member comprises a dispensing aperture which is un-obscured in the open position, the method of dispensing articles may comprise moving the closure member from the closed position to the open position and manoeuvring the container so as to dislodge articles in the container through the dispensing aperture.

Where the dispensing aperture comprises a push out panel defined in the second closure member by means of perforations, the method of dispensing articles may comprise moving the closure member from the closed position to the open position and removing the push out panel so that articles can be dispensed through the aperture.

BRIEF DESCRIPTION OF THE DRAWINGS

The invention will now be described with reference to the accompanying drawings in which:—

DETAILED DESCRIPTION OF PREFERRED EMBODIMENTS

Figure 1A:
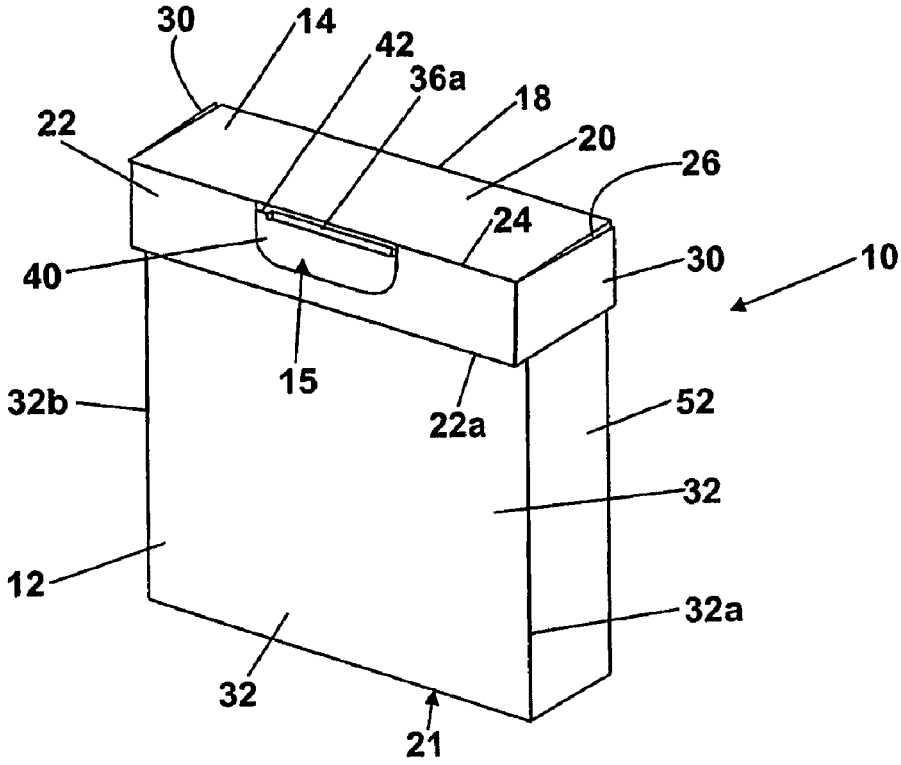
FIG. 1*a* is a perspective view of a front/side elevation of a confectionery container in accordance with a first embodiment of the invention, which is shown in a closed condition.
Figure 3A:
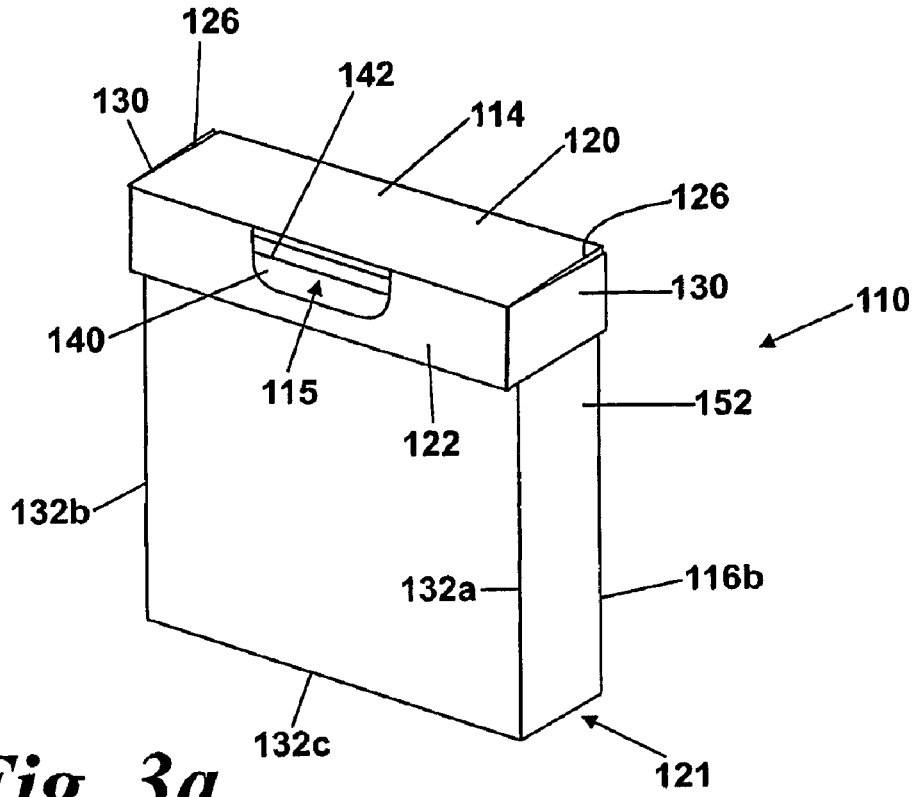
FIG. 3*a* is a perspective view of a front/side elevation of a confectionery container in accordance with a second embodiment of the invention, which is shown in a closed condition.

Throughout this specification, terms such as "upper", "upwardly", "lower", "top" and "bottom", relate to the container or its parts when in a generally upright position as shown in FIG. 1*a*, and 3*a*. It will be appreciated, however, that the container can be held in other orientations and such terms should be construed accordingly.

Figure 1B:
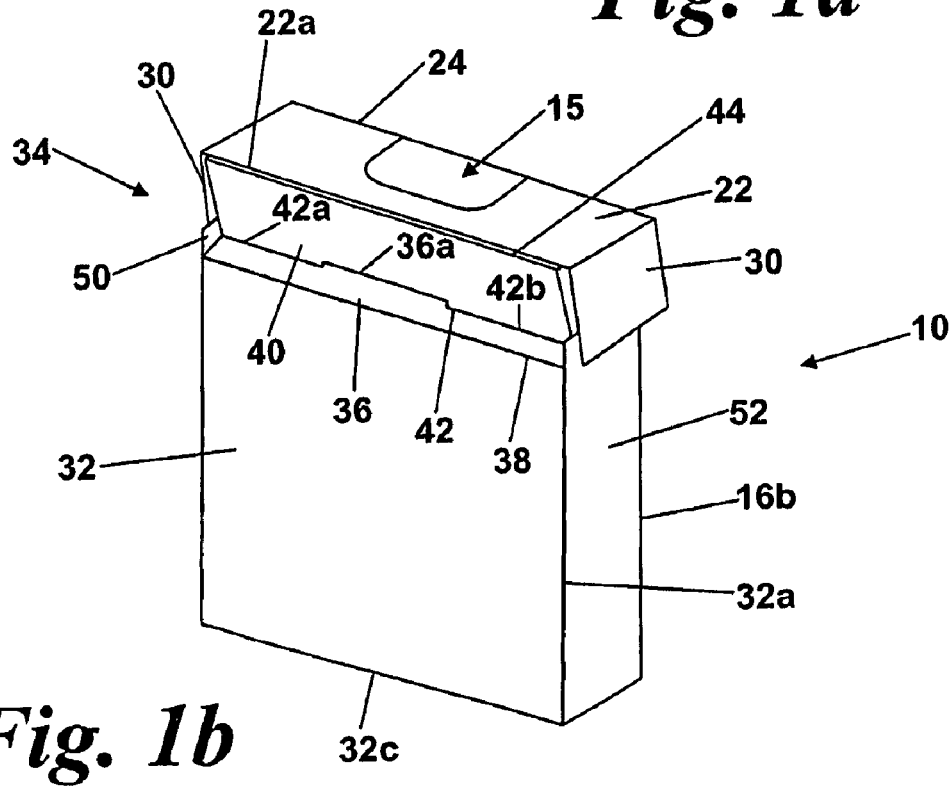
FIG. 1*b* is a perspective view similar to that of FIG. 1*a* but showing the container in an open condition.
Figure 2:
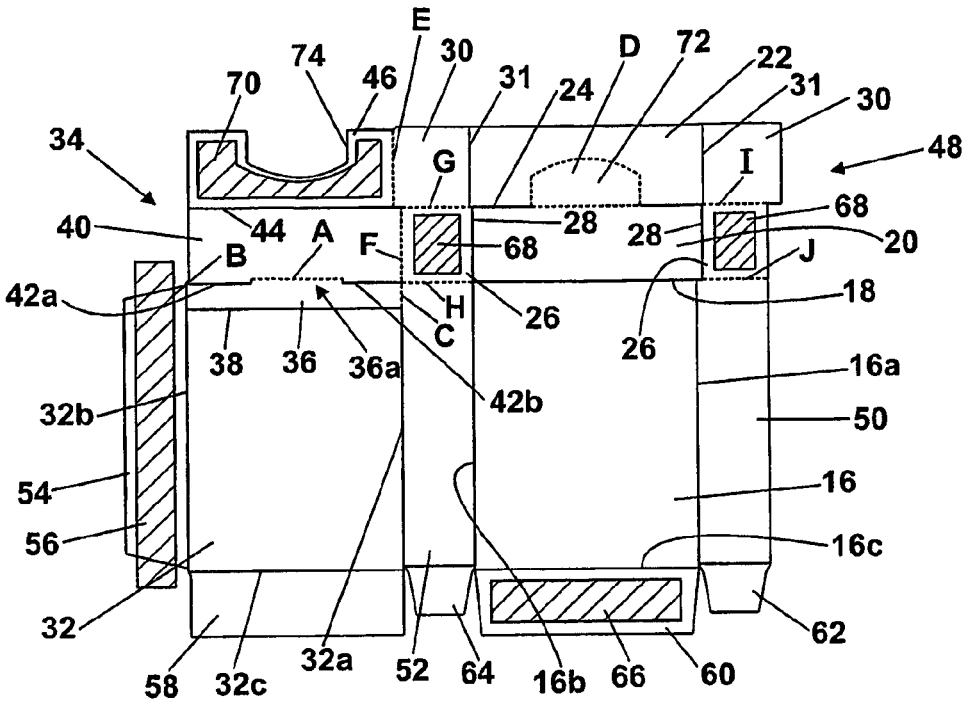
FIG. 2 is a schematic plan view of a blank for making the container of FIGS. 1*a* and 1*b;*

With reference initially to FIGS. 1*a*, 1*b* and 2, a confectionery container 10 in accordance with a first embodiment of the invention comprises a main body 12 which defines a rectangular prism shaped box having an inner volume. The container also has a closure member or lid 14 connected to a rear panel 16 of the main body by means of a fold line 18, which forms a hinge for the closure member. The closure member 14 is movable relative to the main body 12 about the fold line 18 between a closed position as shown in FIG. 1*a* and an open position as shown in FIG. 1*b*. The closure member comprises a dispensing aperture 15, which is obscured when the closure member is closed and which is un-obscured when the closure member 14 is in the open position so that articles contained in the main body can be dispensed through the aperture 15.

The closure member 14 has a first closure member panel 20 which lies substantially parallel to a wall 21 which closes the opposite, bottom end, of the main body when the closure member 14 is in a closed position. The closure member 14 also has a second closure member panel 22 which extends generally perpendicularly to the first closure member panel and which faces towards the front of the container when the closure member 14 is in the closed position. A rear edge of the first closure member panel 20 is connected to an upper edge of the rear panel 16 of the main body 12 by the fold line 18 and a front edge of the first closure member panel 20 is connected to a rear edge of the second closure member panel 22 by means of a further fold line 24. The sides of the closure member are formed by inner side tabs 26 connected to the first closure member panel 20 along fold lines 28 and outer side tabs 30 connected with the second closure member panel 22 along fold lines 31. The inner and outer side tabs 26, 30 on either side are affixed together using an adhesive to form the sides of the closure member and to fix the first 20 and second 22 closure member panels in position relative to one another.

A forward edge 22*a* of the second closure member panel 22 is connected with a front panel 32 of the main body 12 by means of two cooperating panels which comprise an over-centre mechanism, indicated generally at 34 in FIG. 1*b*, configured to bias the closure member 14 into the open and closed positions. The over-centre mechanism 34 includes a minor panel 36 connected to the front panel 32 of the main body by means of a fold line 38 and a major panel 40 connected to the minor panel along a first, lower edge, by means of a further fold line 42. As will be described in more detail later, a second, upper edge of the major panel 40 is connected by a fold line 44 with a tab member 46. The tab member 46 is affixed to the inner surface of the second closure member panel 22 so that the fold line 44 is aligned with the forward edge 22*a* of the second closure member panel 22. The over-centre mechanism 34 thus provides an articulated connection between the forward edge 22*a* of the second closure member panel 22 and the front panel 32 of the main body.

When the closure member 14 is open, as shown in FIG. 1*b*, the minor 36 and major 40 panels extend generally in-line with one another but are angled inwardly slightly towards their common fold line 42, which is inset from the plane of the front panel 32. To close the dispenser, the closure member 14 is pivoted forwardly about the rear hinge 18 to bring the second closure member panel 22 down over the front panel 32 of the main body. During an initial phase of movement, the major panel 40 is moved from the open position shown in FIG. 1*b* to an intermediate position in which it extends generally perpendicularly relative to the plane of minor panel 36. This movement exerts an inwardly and downwardly directed force on the upper edge of the minor panel, which is forced to bend inwardly and downwardly about the fold line 38 between itself and the front panel 32 to a deflected position. As the closure member 14 continues in its closing movement beyond the intermediate position towards the closed position, the major panel 40 becomes inverted as the second edge 22*a* of the second closure member panel moves beyond the fold line 42 between the major 40 and minor 36 panels. This removes the inwardly and downwardly directed force from the upper edge of the minor panel 36, which recovers to its initial position pushing the fold line 38 outwardly. This tends to push the closure member 14 towards the fully closed position.

The term "inverted" is used herein to indicate simply that the major panel pivots about the fold line 42 from a position in which the majority of the panel is located to one side of the fold line to a position in which the majority of the panel is located to the other side of the fold line 42 rather than to imply that the major panel moves between strictly opposing positions.

When the closure member 14 is opened, the above sequence is reversed. Thus the closure member 14 is pivoted about the rear hinge 18 to the intermediate position in which the major panel 40 is aligned substantially perpendicular to the plane of the minor panel 36, pushing the upper edge of the minor panel 36 inwardly and downwardly. Once the closure member 14 moves beyond the intermediate position towards the open position, the force pushing the upper edge of the minor panel is removed and the minor panel 36 recovers to its initial position biasing the fold line 38 outwardly. This pushes the major panel 40 and the closure member 14 into their open positions.

It can be seen, therefore, that the over-centre mechanism 34 biases the closure member 14 firmly into either the open position or the closed position as the closure member moves through the intermediate position.

When the closure member 14 is in the closed position, the dispensing aperture 15 overlies part of the front panel 32 of the main body and is obscured by the inner face of the major panel 40. In the present embodiment, a tab 36*a* on the upper edge of the minor panel 30 extends into the lower edge of the major panel 40 and the fold line 42 between the major and minor panels 40, 36 is divided into two portions 42*a*, 42*b*, one on either side of the tab. When the closure member 14 is closed, the tab 36*a* projects upwardly from the fold line 38 and lies adjacent, or contacts, the inner surface of the first closure member panel 20 to ensure that none of the articles stored in the main body 12 are able to pass between the fold line 38 and the inner surface of the first closure member panel 20 and out of the aperture 15. The tab 36*a* can be omitted if not required.

When the closure member 14 is open, the second closure member panel 22 extends substantially parallel to the wall 21 which closes off the opposite end of the container. In this position articles in the container can be removed by tipping the container 10 to allow the articles to fall through the aperture 15. With the closure member open, the foldable panel assembly 34 closes the gap between the front edge 22*a* of the second closure member panel 22 and the front panel 32 of the main body and, together with the first closure member panel 20 and the side tabs 26, 30, ensures that items to be dispensed can only pass out through the dispensing aperture 15.

The confectionery container 10 is formed from a single unitary blank 48 shown in FIG. 2. The blank 48 is designed to be of compact form and comprises a first elongate side panel 50 foldably connected to a first side edge 16*a* of the rear panel 16. A second side panel 52 is foldably connected to a second side edge 16*b* of the rear panel and is foldably connected to a first side edge 32*a* of the front panel 32. A side tab 54 extends from a second side edge 32*b* of the front panel and is foldably connected thereto. The side tab 54 has a region 56 which is coated in an adhesive for affixing the tab to an inner surface of first side panel 50 when the container is assembled. Bottom end closure panels 58, 60 are foldably connected to the lower edges 32*c*, 16*c* of the front and rear panels 32, 16 respectively, whilst bottom end closure tabs 62, 64 are foldably connected to the lower edges of the first and second elongate side panels. A region of adhesive 66 is provided on one of the end closure panels 60 to affix the panel to the other end closure panels 58 when the container is assembled to hold end wall 21 in position.

The first and second elongate side panels 50, 52, the front and rear panels 32, 16, the side tab 54, the bottom end closure panels 58, 60 and the bottom end closure tabs 62, 64 together form the main body 12 of the container and define a generally rectangular prism container which is closed at the bottom and open at the top when the main body of the container is formed.

In the present embodiment, the closure member panels 20, 22 are both connected, directly or indirectly via fold lines with the upper edge of the rear panel 16 of the main body 12. Thus the first closure member panel 20 is foldably connected directly to an upper edge of the rear panel 16 by the fold line 18, which forms the main closure member hinge. The second closure member panel 22 is in turn foldably connected to the upper edge of the first closure member panel 20 by means of the fold line 24. The inner side tabs 26 of the closure member are foldably connected along opposite side edges of the first closure member panel 20 by means of fold lines 28 and the outer side panels of the closure member 30 are foldable connected with opposing side edges of the second closure member panel 22 by means of the fold lines 31. Regions of adhesive 68 are provided on the outer surface of the inner side tabs 26 to affix the inner and outer side tabs together when the container is assembled The cooperating panels which form the over-centre mechanism 34 are formed integrally with the front panel 32 of the main body 12. Thus the minor panel 36 is foldably connected to the upper edge of the front panel 32 by means of the fold line 38 and the major panel 40 is foldable connected to the upper edge of the minor panel 36 by means of the split fold line 42*a*, 42*b*. The tab 30*a* is defined by means of a first arrangement of perforations A. The tab member 46 for attaching the major panel 40 to the closure member 14 is foldably connected with the upper edge of the major panel 40 via the fold line 44 and carries a region of adhesive 70 by means of which it can be affixed to the inner surface of the second closure member panel 22. Lines of perforations B, C separate the side edges of the minor panel 36 from the side tab 54 and the second elongate side panel 52 respectively, where these overlap.

A further arrangement of perforations D in the second closure member panel 22 define a push out panel 72 when can be removed to form the dispensing aperture 15. The push out panel may be removed by an end user when the container is first opened or it may be removed as part of the assembly and filling operations. The tab member 46 is shaped so as not to obscure the dispensing aperture 15 and thus includes a cut-out or recess 74 in its upper edge which conforms to the shape of the push out panel 72.

The side edges of the inner and outer side tabs 26, 30 to the left (as shown) of the first and second closure member panels 20, 22 are separated from the inner side edges of the tab member 46 and the major panel 40 respectively by means of perforations E and F. Similarly, the upper and lower edges of the inner side tabs 26 are separated from the outer side tabs 30 and the first and second elongate side panels 50, 52 by means of further lines of perforation G to J.

To construct the confectionery container 10, the main body 12 is formed by folding the front and rear panels 32, 16 and the first and second side panels 50, 52 and the side tab 54 along their respective fold lines 16*a*, 16*b*, 32*a*, 32*b* and affixing the side tab 54 to the inner surface of the first side panel 50. The end wall 21 is then formed by folding the bottom end closure tabs 62, 64 inwardly followed by a first of the bottom end closure panels 60. The other bottom end closure panel 58 is then also folded and affixed to the first of the bottom end closure panels 60 by means of the adhesive 66. The main body 12 of the container is thus formed in a generally conventional manner. At this stage, the items to be contained in the container can be introduced into the receptacle formed by the main body 12 through the open upper end.

The closure member is formed by folding the second closure member panel 22 backwardly (as shown) so that it extends generally at right angles to the plane of the first closure member panel 20. The over-centre mechanism 34 is then attached to the closure member by folding the tab member 46 backwardly (as shown) about the fold line 44 and pressing the tab member 46 into contact with the inner surface of the second hinge panel 22 so that the two are affixed by the adhesive 70. The inner side tabs 26 are then folded down to close the sides of the closure member 14 and the outer side tabs 30 folded down over the inner side tabs 26 and affixed thereto using the adhesive 68. This holds the first and second closure member panels 20, 22 in position relative to each other. In an alternative arrangement, the inner and outer side tabs 26. 30 may be folded into position before the tab member 46 is adhered to the second closure member panel 22.

The perforations A, B, C, E, F, G, H I, J can be separated before folding commences or during the folding process as required.

It will be appreciated that in an alternative arrangement, the tab member 46 could be connected by a fold line with the second closure member panel 22 and secured to the major cooperating panel 40 by means of the adhesive. Indeed, in the constructed container 10, the first and second closure member panels 20, 22 and the major and minor cooperating panels 40, 36 form a continuous chain interconnecting the front 32 and rear 16 panels of the main body when the tab 46 is secured in position and it should be appreciated that the tab 46 can be provided at any suitable point in the chain.

Figure 4:
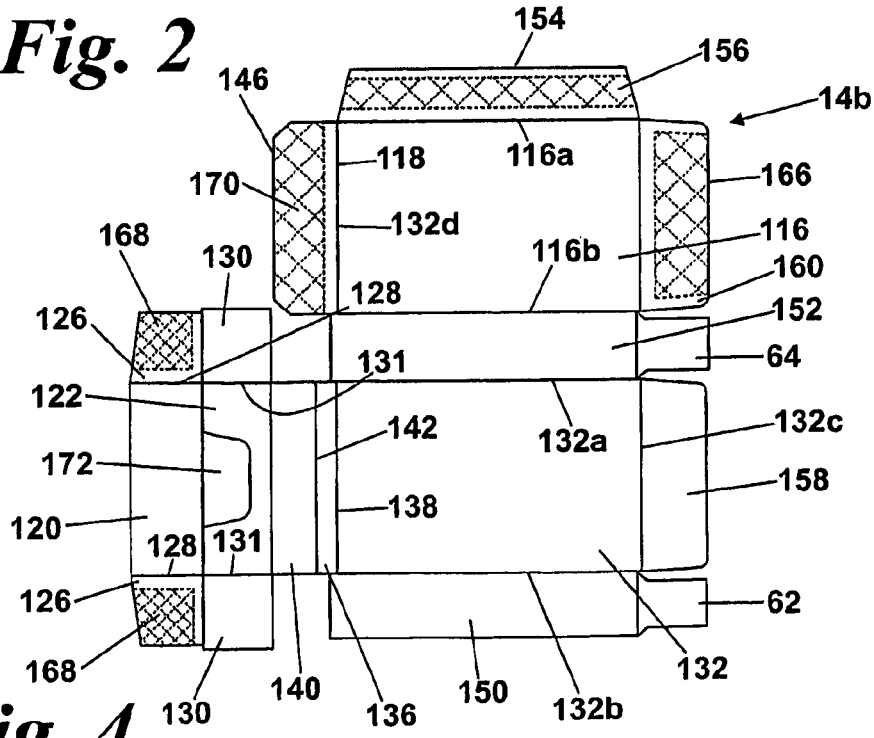
FIG. 4 is a schematic plan view of a blank for making the container of FIGS. 3*a* and 3*b*.
Figure 3B:
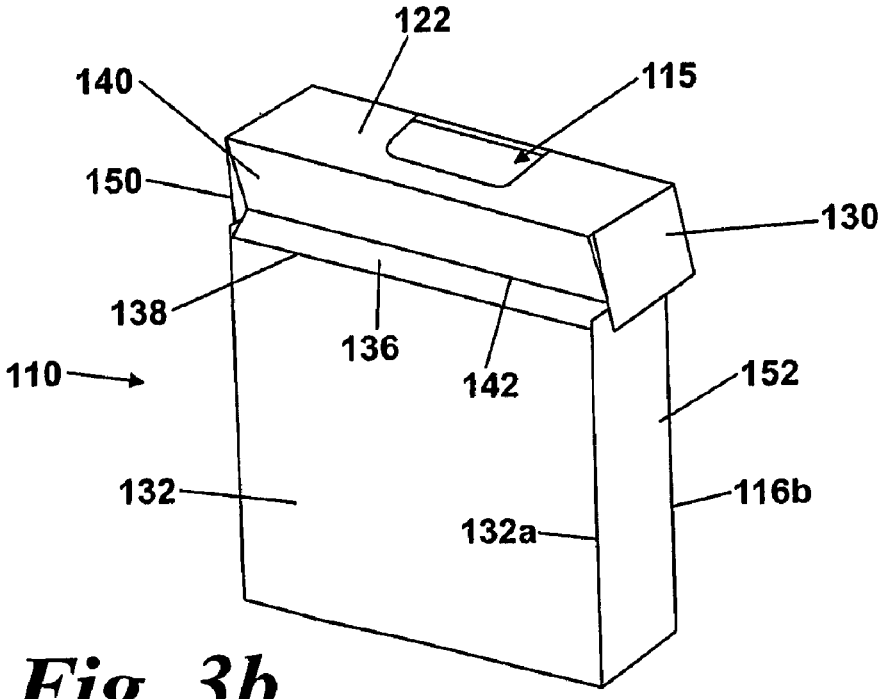
FIG. 3*b* is a view similar to that of FIG. 3*a* but showing the container in an open condition.

FIGS. 3*a*, 3*b* and 4 illustrate a second embodiment of a confectionery container 100 in accordance with the invention. Features of the second embodiment which are the same as or which perform the same function as those of the previous embodiment are given the same reference numeral but increased by 100.

The confectionery container 100 in accordance with the second embodiment is constructed and operates essentially in the same manner as the container 10 in accordance with the first embodiment, the main difference between the two embodiments being in the nature of the blank 148 which is used to form the container. Thus, in the second embodiment 100, the first and second closure member panels 120, 122 are attached, either directly or indirectly, to the upper edge of the major panel 140 of the over-centre mechanism 134 rather than to the upper edge of the rear panel 116 as in the first embodiment. In order to attach the closure member 114 to the rear panel 116, a tab member 146 is foldably attached to the upper edge 116*d* of the rear panel 116 via a fold line 118, which forms the main hinge of the closure member 114 when the container is assembled. An area of adhesive 170 is provided on the tab member 146 to affix the tab member 146 to the outer surface of the first closure member panel 120 when the container is assembled.

The blank 148 for the second embodiment also differs from the first blank 48 in that the first side panel 150 is foldable connected to the second side edge 132*b* of the front panel 132 whilst the side tab 154 is foldable connected to the first side edge 16*a* of the rear panel.

To construct the container 100 in accordance with the second embodiment, the front and rear panels 132, 116, the first and second side panels 150, 152, and the side tab 154 are folded and the tab affixed to the inner surface of the first side panel 150. The bottom end closure wall 121 is then formed as previously described in respect of the first embodiment to complete construction of the main body 112. The container can then be filled.

To form the closure member 14, the first closure member panel 120 is folded rearwardly (as shown) about the fold line 131 until it extends generally perpendicularly to the plane of the second closure member panel 122 and the tab member 146 is affixed to the inner surface of the first closure member panel 120. The inner and outer side tabs 126, 130 on either side of the closure member panels are then folded into position and affixed to one another. Again, the side tabs 126, 130 may be folded and fixed in position before the tab 146 is affixed to the first closure member panel 120 if required.

In an alternative arrangement, the closure member tab member 146 may be connected with the first closure member panel 120 by a fold line and secured to the rear panel 116 by means of adhesive. This embodiment illustrates an alternative position for the closure member tab 146 which links the first and second closure member panels 20, 22, the major and minor cooperating panels 36, 40 and the front and rear panels 32, 16 of the main body 12.

The container 100 once constructed operates in the same manner as the container 10 of the first embodiment the description of which should be referred to for detail.

In the second embodiment, there is no tab 136*a* on the upper edge of the minor panel 136. However, such a tab could be provided if required.

Construction of the container 10, 100 from the blank 48, 148 may be automated in a manner known in the art and it will be appreciated that the order of construction can be varied. The adhesive used may be of any suitable type and may be a pressure or heat sensitive adhesive which is pre-applied to the blank.

It can be seen then that a container 10, 100 in accordance with the invention can be simply constructed from a singe unitary blank of a suitable material, such as card, a laminate or the like.

The container is easy to use and is particularly suitable for containing items in pellet or tablet form and especially confectionery items including chewing gum pellets, mints or the like. However, the container 10, 100 can be used to contain and dispense a variety of items including medical tablets.

It is of course to be understood that the invention is not intended to be restricted to the details of the above embodiments, which are described by way of example only. Thus, for example, the main body may be generally square in shape or polygonal in shape, the closure member being of cooperating shape. It will also be apparent to those skilled in the art that blanks for forming a container in accordance can be constructed in a variety of different ways.

The invention claimed is:

1. A confectionery container comprising a main body defining an inner volume in which articles can be held and a closure member pivotably attached to the main body for movement between an open position in which articles within the inner volume can be dispensed and a closed position in which the articles are retained within the container, the container further comprising an over-centre mechanism arranged to bias the closure member towards the open and closed positions, the over-centre mechanism comprising two cooperating panels pivotably connected to one another along a first fold line, a first one of the panels being pivotably connected with the closure member and a second of the cooperating panels being pivotably connected with a panel forming part of the main body, the main body comprising opposing front and rear panels, the closure member being pivotably connected with the rear panel of the main body, the first cooperating panel being pivotably connected with a forward edge of the closure member and the second cooperating panel being pivotably connected with the front panel of the main body, the closure member comprising two closure member panels, a first closure member panel pivotably connected with the rear panel of the main body and a second closure member panel which extends generally perpendicularly to the first closure member panel, and in which the second closure member panel has a dispensing aperture and is arranged to at least partially overlie the front panel of the main body and the first and second cooperating panels when the closure member is in the closed position, so that the aperture is at least partially obscured and the dispensing aperture is un-obscured when the closure member is in the open position.

2. A confectionery container as claimed in claim 1, in which the container is constructed from one or more sections of foldable material.

3. A confectionery container as claimed in claim 2, in which the container is formed from a unitary blank of foldable material.

4. A confectionery container as claimed in claim 1, in which the cooperating panels are configured so as to lie generally in-line with each other when the closure is in the open position.

5. A confectionery container as claimed in claim 4, in which the first and second cooperating panels are configured so as to angle inwardly towards their adjoining ends when the closure member is in the open position, such that the first fold line is offset inwardly from the plane of the main body panel.

6. A confectionery container as claimed in claim 4, in which the cooperating panels are configured so that the first and second cooperating panels overlie one another when the closure member is in the closed position.

7. A confectionery container as claimed in claim 6, in which the cooperating panels are configured so that, in use, as the closure member moves between the open and closed positions, the first cooperating panel pivots about the first fold line and is inverted, the closure member passing through an intermediate position between the open and closed positions in which the first cooperating panel extends generally perpendicularly to the plane of the second cooperating panel.

8. A confectionery container as claimed in claim 7, in which the cooperating panels are configured so that, in use when the closure member is moved from the open position to the closed position, during movement of the closure member from the open position to the intermediate position, a force is exerted on the second cooperating panel through the first cooperating panel biasing the second cooperating panel inwardly from an initial position, after which, during further movement of the closure member towards the closed position beyond the intermediate position, the force on the second cooperating panel is removed and the second panel is able to recover towards its initial position biasing the closure member towards the closed position.

9. A confectionery container as claimed in 8, in which the cooperating panels are arranged so that, in use when the closure member is moved from the closed position to the open position, during movement of the closure member from the closed position towards the intermediate position, a force is exerted on the second cooperating panel through the first cooperating panel biasing the second cooperating panel inwardly from an initial position, after which, during further movement of the closure member towards the open position beyond the intermediate position, the force exerted on the second cooperating panel is removed and the second cooperating panel is able to recover towards its initial position biasing the closure member towards the open position.

10. A confectionery container as claimed in claim 9, in which the first cooperating panel is a major panel and the second cooperating panel is shorter minor panel.

11. A confectionery contain as claimed in claim 10, in which the closure member is provided at one end of the main body, the second closure member panel being arranged to extend substantially parallel to a wall which closes an opposing end of the main body when the closure member is in the open position.

12. A confectionery container as claimed in claim 11, in which the dispensing aperture is provided by means of a push out panel defined in the second closure member panel by means of perforations.

13. A confectionery container as claimed in claim 11, in which the first closure member panel is connected with the rear panel of the main body by a fold line and to the second closure member panel by a further fold line, the container further comprising a tab member pivotably connected to one of the first cooperating panel and the second closure member panel by a yet further fold line, the tab member being secured to the other of the first cooperating panel and the second closure member panel.

14. A confectionery container as claimed in claim 1, in which the second closure member panel is connected with the first cooperating panel by means of a fold line and to the first closure member panel by means of a further fold line, the container further comprising a tab member pivotably connected with one of the rear panel of the main body and the first closure member panel by means of a yet further fold line, the tab member being secured to the other of the rear panel and the first closure member panel.

15. A confectionery container as claimed in claim 13, in which the tab member is secured using an adhesive.

16. A confectionery container as claimed in claim 14, in which the closure member further comprises side tabs to enclose the region between the closure member panels and the first cooperating panel when the closure member is in the open position.

17. A method of dispensing articles from a confectionery container as claimed in claim 1, the method comprising: moving the closure member from the closed position to the open position; manoeuvring the container so as to dislodge articles in the container to be dispensed.

18. A method as claimed in claim 17, the method further comprising moving the closure member from the open position to the closed position to retain the remaining articles within the container.

19. A method as claimed in claim 17, in which the step of moving the closure member to the closed position causes the over-centre mechanism to bias the second closure panel into a close relationship with the front panel and the first and second cooperating panels.

20. A method as claimed in claim 17, in which the method of dispensing articles comprises moving the closure member from the closed position to the open position and manoeuvring the container so as to dislodge articles in the container through the dispensing aperture.

21. A method as claimed in claim 17, in which the method of dispensing articles comprises moving the closure member from the closed position to the open position and removing the push out panel so that articles can be dispensed through the aperture.

22. A blank for forming a confectionery container comprising a main body defining an inner volume in which articles can be held and a closure member pivotably attached to the main body for movement between an open position in which articles within the inner volume can be dispensed and a closed position in which the articles are retained within the container, the container further comprising an over-centre mechanism arranged to bias the closure member towards the open and closed positions, the over-centre mechanism comprising two cooperating panels pivotably connected to one another along a first fold line, a first one of the panels being pivotably connected with the closure member and a second of the cooperating panels being pivotably connected with a panel forming part of the main body, the main body comprising opposing front and rear panels, the closure member being pivotably connected with the rear panel of the main body, the first cooperating panel being pivotably connected with a forward edge of the closure member and the second cooperating panel being pivotably connected with the front panel of the main body, the closure member comprising two closure member panels, a first closure member panel pivotably connected with the rear panel of the main body and a second closure member panel which extends generally perpendicularly to the first closure member panel, and in which the second closure member panel has a dispensing aperture and is arranged to at least partially overlie the front panel of the main body and the first and second cooperating panels when the closure member is in the closed position, so that the aperture is at least partially obscured and the dispensing aperture is un-obscured when the closure member is in the open position.

23. A blank as claimed in claim 22, the blank comprising two cooperating panels pivotably connected with a panel portion for forming part of the main body, the two cooperating panels being interconnected by a fold line.

24. A blank as claimed in claim 22, the blank comprising four panel portions connected by fold lines which define the front, rear and two side panels of the main body of the container, the blank further comprising a first closure member panel connected to the rear panel portion by a fold line, a second closure member panel connected to the first closure member panel by a fold line, a second cooperating panel connected with the front panel portion by a fold line and a first cooperating panel connected with the second cooperating panel by a fold line, and a tab member connected with one of the first cooperating panel and the second closure member panel by a fold line, the tab member carrying a region of adhesive by means of which it can be affixed to the other of the first cooperating panel and the second closure member panel.

25. A blank as claimed in claim 22, the blank comprising four panel portions connected by fold lines which define front, rear and two side panels of the main body of the container, the blank further comprising a second cooperating panel connected with the front panel portion by a fold line and a first cooperating panel connected with the second cooperating panel by a fold line, a second closure member panel connected with the first cooperating panel by a fold line, and a first closure member panel connected with the second closure member panel by a fold line, and a tab member connected with one of the rear panel portion and the first closure member panel by a fold line, the tab member carrying a region of adhesive by means of which it can be affixed to the other of the rear panel portion and the first closure member panel.

26. A blank as claimed in claim 22, the blank further comprising end closure panels and tabs for forming an end closure at an end of the main body opposite from the closure member.

27. A blank as claimed in claim 22, in which adhesive is provided on one or more faces of the blank to facilitate assembly.

* * * * *